US010966047B1

(12) United States Patent
Tong et al.

(10) Patent No.: US 10,966,047 B1
(45) Date of Patent: Mar. 30, 2021

(54) WIRELESS AUDIO SYSTEM FOR RECORDING AN AUDIO INFORMATION AND METHOD FOR USING THE SAME

(71) Applicant: BESTECHNIC (SHANGHAI) CO., LTD., Shanghai (CN)

(72) Inventors: Weifeng Tong, Shanghai (CN); Liang Zhang, Shanghai (CN); Mingliang Xu, Shanghai (CN)

(73) Assignee: BESTECHNIC (SHANGHAI) CO., LTD., Shanghai (CN)

( * ) Notice: Subject to any disclaimer, the term of this patent is extended or adjusted under 35 U.S.C. 154(b) by 0 days.

(21) Appl. No.: 17/107,876

(22) Filed: Nov. 30, 2020

(30) Foreign Application Priority Data

Oct. 13, 2020 (CN) ..... 202011087986.2

(51) Int. Cl.

| | |
|---|---|
| ***H04S 7/00*** | (2006.01) |
| ***G10L 25/21*** | (2013.01) |
| ***H04R 29/00*** | (2006.01) |
| ***H04R 5/033*** | (2006.01) |
| ***H04R 1/10*** | (2006.01) |
| ***H04R 1/08*** | (2006.01) |

(52) U.S. Cl.
CPC ..... *H04S 7/304* (2013.01); *G10L 25/21* (2013.01); *H04R 1/08* (2013.01); *H04R 1/1041* (2013.01); *H04R 5/033* (2013.01); *H04R 29/001* (2013.01); *H04R 1/1016* (2013.01); *H04S 2400/11* (2013.01); *H04S 2400/15* (2013.01)

(58) Field of Classification Search
CPC ..... H04R 5/033; H04R 1/08; H04R 1/1041; H04R 29/001; H04R 1/1016; H04S 7/304; H04S 2400/11; H04S 2400/15; G10L 25/21
See application file for complete search history.

(56) References Cited

U.S. PATENT DOCUMENTS

| | | | | |
|---|---|---|---|---|
| 10,412,481 | B1 * | 9/2019 | Wu | H04R 1/1041 |
| 2019/0261089 | A1 * | 8/2019 | Hariharan | H04R 5/04 |

FOREIGN PATENT DOCUMENTS

| | | | |
|---|---|---|---|
| CN | 1084155685 | * | 8/2018 |

* cited by examiner

*Primary Examiner* — Regina N Holder
(74) *Attorney, Agent, or Firm* — Bayes PLLC

(57) ABSTRACT

Embodiments of wireless audio systems and methods for wirelessly communicating audio are disclosed herein. In one example, a method for generating a 3D audio representation of an audio is disclosed. The method includes collecting, by a first wireless headphone, a first audio signal of the audio and generating, by the first wireless headphone, a first synchronizing signal based on a local clock of the first wireless headphone. The method also includes collecting, by a second wireless headphone, a second audio signal of the audio and generating, by the second wireless headphone, a second synchronizing signal based on a local clock of the second wireless headphone. The method yet includes generating, by a user equipment, the 3D audio representation of the audio based on the first and the second audio signals and the first and the second synchronizing signals.

17 Claims, 13 Drawing Sheets

700

WIRELESS AUDIO SYSTEM FOR RECORDING AN AUDIO INFORMATION AND METHOD FOR USING THE SAME

CROSS-REFERENCE TO RELATED APPLICATION

This application claims the benefit of priority to Chinese Patent Application No. 202011087986.2, filed on Oct. 13, 2020, which is incorporated herein by reference in its entirety.

BACKGROUND

Embodiments of the present disclosure relate to wireless audio systems.

Loudspeakers, including headphones, have been widely used in daily life. Headphones are a pair of small loudspeaker drivers worn on or around the head over a user's ears, which convert an electrical signal to a corresponding sound.

Wired headphones, however, constrain the users' movement because of the wires (cords), and are particularly inconvenient during exercise. Conventional wireless headphones no longer need the wires between the headphones and the user equipment but still require the wires between the left and right headphones.

SUMMARY

Embodiments of wireless audio systems and methods for recording an audio are disclosed herein.

In one example, the wireless audio system includes a first wireless headphone, a second wireless headphone, and a user equipment. The first wireless headphone includes a first audio collection module configured to collect a first audio signal of the audio and a first timing module configured to generate a first counting signal based on a first local clock of the first wireless headphone. The first wireless headphone further includes a first control module, upon receiving a trigger from the first audio collection module is configured to record the first synchronizing signal from the timing module and receive a portion of the first audio signal by direct memory access (DMA). The second wireless headphone is configured to receive a wireless signal from the first wireless headphone, indicating the first local clock and synchronize a second local clock of the second wireless headphone with the first local clock based on the wireless signal. The second wireless headphone includes a second audio collection module configured to collect a second audio signal of the audio, and a second timing module configured to generate a second synchronizing signal based on the second local clock of the second wireless headphone. The second wireless headphone further includes a second control module, upon receiving a trigger from the second audio collection module, is configured to record the second synchronizing signal from the second timing module and receive a portion of the second audio signal by DMA. The user equipment is configured to generate a 3D audio representation of the audio based on the first and the second audio signal and the first and the second synchronizing signals.

In another example, a wireless audio system includes a first wireless headphone and a second wireless headphone. The first wireless headphone is configured to collect a first audio signal of a test audio. The second wireless headphone is configured to collect a second audio signal of the test audio. The first wireless headphone is further configured to generate a first and a second adjustment signals based on the test audio, the first audio signal, and the second audio signal. The first and the second adjustment signals are configured to adjust least one of a gain or a phase of the first and the second audio signal, respectively. The first wireless headphone is also configured to adjust the first audio signal based on the first adjustment signal.

In still another example, a method for generating a 3D audio representation of an audio is disclosed. The method includes collecting, by a first wireless headphone, a first audio signal of the audio and generating, by the first wireless headphone, a first synchronizing signal based on a local clock of the first wireless headphone. The method also includes collecting, by a second wireless headphone, a second audio signal of the audio and generating, by the second wireless headphone, a second synchronizing signal based on a local clock of the second wireless headphone. The method yet includes generating, by a user equipment, the 3D audio representation of the audio based on the first and the second audio signals and the first and the second synchronizing signals.

This Summary is provided merely for purposes of illustrating some embodiments to provide an understanding of the subject matter described herein. Accordingly, the above-described features are merely examples and should not be construed to narrow the scope or spirit of the subject matter in this disclosure. Other features, aspects, and advantages of this disclosure will become apparent from the following Detailed Description, Figures, and Claims.

BRIEF DESCRIPTION OF THE DRAWINGS

The accompanying drawings, which are incorporated herein and form part of the specification, illustrate the presented disclosure and, together with the description, further serve to explain the principles of the disclosure and enable a person of skill in the relevant art(s) to make and use the disclosure.

Figure 1A:
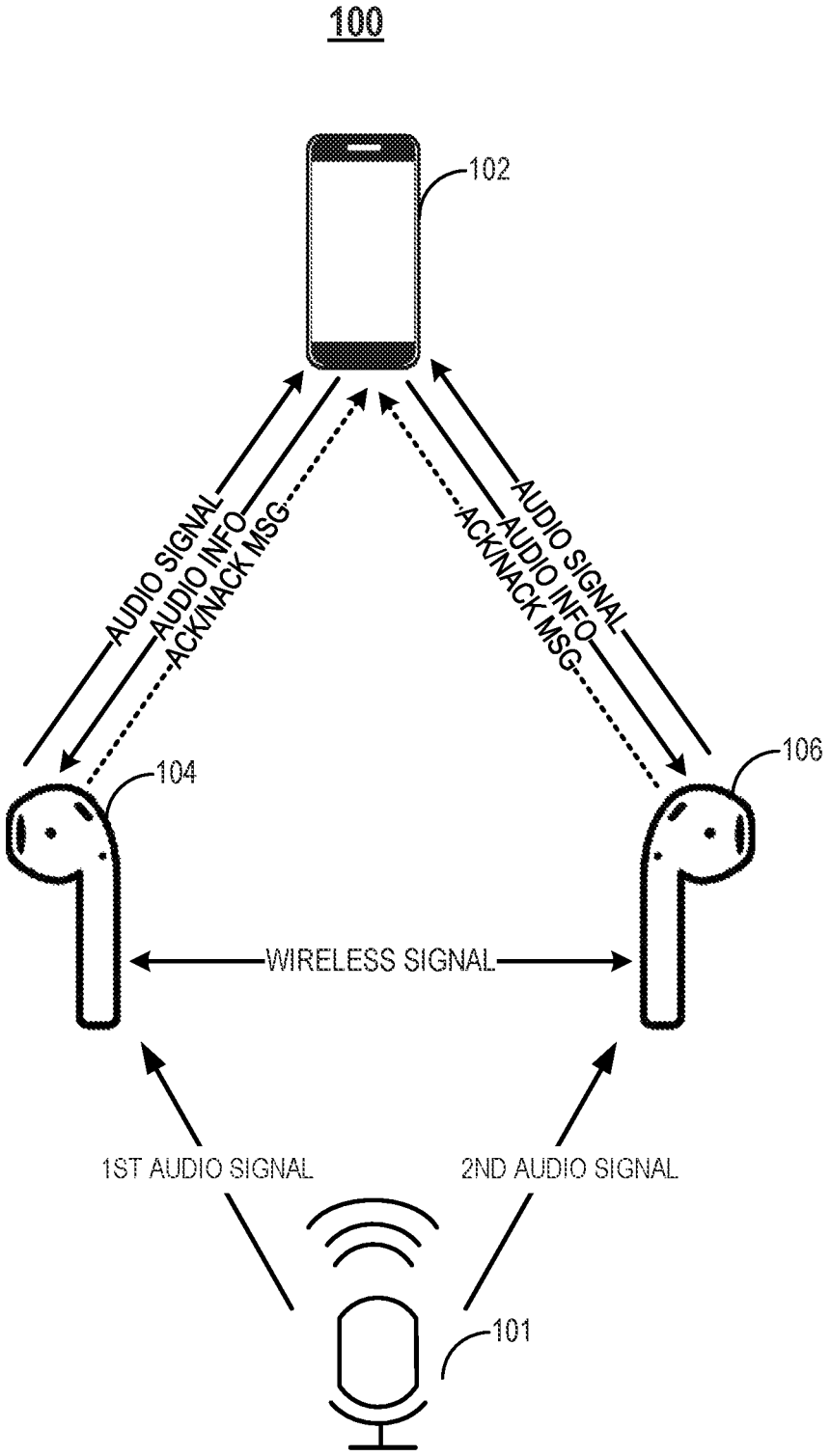
FIGS. 1A-1C are block diagrams illustrating an exemplary wireless audio system in accordance with various embodiments.

The presented disclosure is described with reference to the accompanying drawings. In the drawings, generally, like reference numbers indicate identical or functionally similar elements. Additionally, generally, the left-most digit(s) of a reference number identifies the drawing in which the reference number first appears.

DETAILED DESCRIPTION

Although specific configurations and arrangements are discussed, it should be understood that this is done for illustrative purposes only. It is contemplated that other configurations and arrangements can be used without departing from the spirit and scope of the present disclosure. It is further contemplated that the present disclosure can also be employed in a variety of other applications.

It is noted that references in the specification to "one embodiment," "an embodiment," "an example embodiment," "some embodiments," etc., indicate that the embodiment described may include a particular feature, structure, or characteristic, but every embodiment may not necessarily include the particular feature, structure, or characteristic. Moreover, such phrases do not necessarily refer to the same embodiment. Further, when a particular feature, structure or characteristic is described in connection with an embodiment, it is contemplated that such feature, structure or characteristic may also be used in connection with other embodiments whether or not explicitly described.

In general, terminology may be understood at least in part from usage in context. For example, the term "one or more" as used herein, depending at least in part upon context, may be used to describe any feature, structure, or characteristic in a singular sense or may be used to describe combinations of features, structures or characteristics in a plural sense. Similarly, terms, such as "a," "an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

True wireless stereo (TWS) headphones (also known as untethered headphones) is a type of wireless headphones that remove the wires between the left and right headphones. In some TWS headphones, a primary wireless headphone can simultaneously communicate with a user equipment (also referred to as "user device" hereinafter) and a secondary wireless headphone. For example, the user device transmits data (music, audio, or data packets) to the primary wireless headphone using BLUETOOTH, and the primary wireless headphone then forwards the data to the secondary wireless headphone.

Besides playing the data received from a user device, the wireless headphones can also be used for recording an audio (e.g., a piece of audio information played/made by one or more audio sources). Specifically, as the primary and the secondary wireless headphones are placed at a different position (e.g., on the different side of a user's head) while being used, the audio signal collected/recorded respectively by the primary and the secondary wireless headphones can be mixed/combined for generating, such as a 3D representation (e.g., spatial sound) of the audio with the sense of orientation and the sense of space. Thus, wireless headphones are particularly suitable for recording the audio.

Existing wireless headphones lack the ability to synchronize the audio signals collected/recorded respectively by the primary and the second wireless headphones. Also, the gain difference and the phase differences of the audio signals collected/recorded respectively by the primary and the second wireless headphones cannot be eliminated. Thus, using the existing schemes, the audio signals collected/recorded respectively by the primary and the second wireless headphones cannot be combined to generate a high-quality 3D representation of the audio to be recorded. Moreover, in existing wireless headphones systems, one wireless headphone is often configured to receive the collected audio signal from the other wireless headphone and is further configured to collectively transmit the audio signals (e.g., collected by both wireless headphones) to the user device. For example, the secondary wireless headphone would transmit the collected audio signal to the primary wireless headphone, which then transmits both the audio signals collected/recorded respectively by the primary and the second wireless headphones to a user devise (e.g., an smart phone) for generating the 3D representation of the audio. Transmitting the collected audio signal between the primary and the secondary wireless headphones would take up a lot of slots (e.g., the unit of the physical channel of the wireless communication connection) of the wireless communication link between the primary and the second wireless headphones. This would reduce the reliability and efficiency of the wireless headphone system.

As will be disclosed in detail below, among other novel features, the wireless audio systems disclosed herein synchronize the audio signals collected/recorded respectively by the primary and the second wireless headphones before combing them to generate the 3D representation of the audio to be recorded. The primary and the second wireless headphones can also be calibrated based on playing a test audio to reduce/eliminate the gain difference and the phase difference of the audio signals recorded respectively by the primary and the second wireless headphones. Moreover, the primary and the secondary wireless headphone can respectively communicate with the user device, e.g., according to a predetermined time-division arrangement. Thus, the amount of data transmitted between the primary and the second wireless headphones can be reduced.

In some embodiments of the present disclosure, each wireless headphone (e.g., the primary wireless headphone and the secondary wireless headphone) includes an audio collection module configured to collect/record an audio signal of the audio (e.g., including an audio of interest and environmental noise) and a timing module configured to generate a counting signal indicating a length/duration and a synchronizing signal recording the starting point of the collected audio signal based on a local clock of the wireless headphone. The audio signals and the synchronizing signals can be transmitted to the user device for synchronizing the audio signals to generate the 3D representation of the audio to be recorded, e.g., the user device can synchronize the audio signals based on the synchronizing signals corresponding to the audio signals, e.g., align the start of the audio signals based on the corresponding synchronizing signals.

In some embodiments, the primary wireless headphone and the secondary wireless headphone may be calibrated using a test device. In some embodiments, the test device can be an audio source for playing a test audio communicating with the primary wireless headphone and the secondary wireless headphone wirelessly or through wire, configured to play a test audio. In some other embodiments, the test device may be the primary wireless headphone or the secondary wireless headphone.

For example, when the test device is independent from the primary wireless headphone or the secondary wireless headphone, each of the primary wireless headphone and the secondary wireless headphone may respectively collect/record an audio signal of the test audio. The secondary wireless headphone may transmit the collected audio signal to the primary wireless headphone, where adjustment signals adjusting at least one of a gain or a phase of the audio signal is generated based on comparing the test audio with the audio signal collected by the primary wireless headphone and the audio signal collected by the secondary wireless headphone. In some embodiments, the adjustment signals may be generated based on comparing the audio signal collected by the primary wireless headphone and the audio signal collected by the secondary wireless headphone. In some other embodiments, the audio signals collected respectively by the primary and the secondary wireless headphones are both transmitted to a charging case (e.g., configured to charge the primary wireless headphone or the secondary wireless headphone) for the gain and/or phase calibration while the primary and the secondary wireless headphones are sitting in the charging case. The audio signals can be transmitted through a wire, e.g., through contact points (will be described in detail below). This can further increase the reliability and efficiency of the data transmission.

Accordingly, as the primary and the secondary wireless headphones are both calibrated to record the audio signal with substantially the same gain and phase (e.g., with differences smaller than a predetermined threshold) and the audio signals collected respectively by the primary and the secondary wireless headphone are synchronized when being mixed/combined for generating the 3D representation of the audio played, the 3D representation of the audio generated may have better quality comparing to existing recording schemes.

Additional novel features will be set forth in part in the description which follows, and in part will become apparent to those skilled in the art upon examination of the following and the accompanying drawings or may be learned by production or operation of the examples. The novel features of the present disclosure may be realized and attained by practice or use of various aspects of the methodologies, instrumentalities, and combinations set forth in the detailed examples discussed below.

FIG. 1A is a block diagram illustrating an exemplary wireless audio system 100 in accordance with an embodiment. As described above, wireless audio system 100 may be used for playing the audio information transmitted from a user device or for recording an audio generated by an audio source. When used for playing the audio information, wireless audio system 100 may include a user device 102, a primary wireless headphone 104 (e.g., the first wireless headphone), and a secondary wireless headphone 106 (e.g., the second wireless headphone). When recording the audio and generating a 3D representation of the audio, wireless audio system 100 may further include an audio source 101 for generating the audio.

Audio source 101 may be any suitable audio source that can make the sound of an audio of interest, or any suitable device that can play the audio of interest including, for example, music, human voice, environmental sound, etc. in any format. User device 102 may be any suitable device that can be used for recording and may also provide audio information including, for example, music or voice in the digital or analog format for primary wireless headphone 104 and secondary wireless headphone 106 to play. User device 102 may include, but is not limited to, a handheld device (e.g., dumb or smart phone, tablet, etc.), a wearable device (e.g., eyeglasses, wrist watch, etc.), a radio, a music player, an electronic musical instrument, an automobile control station, a gaming console, a television set, a laptop computer, a desktop computer, a netbook computer, a media center, a set-top box, a global positioning system (GPS), or any other suitable device.

Primary wireless headphone 104 and secondary wireless headphone 106 may be a pair of loudspeakers that can be worn on or around the head over a user's ears. Primary wireless headphone 104 and secondary wireless headphone 106 may be any electroacoustic transducers that convert an electrical signal (e.g., representing the audio information provided by user device 102) to a corresponding sound and may include a microphone (MIC) of any kind (e.g., a digital MIC or an analog MIC) for collecting/recording audio signals. In some embodiments, each primary wireless headphone 104 and secondary wireless headphone 106 may be an earbud (also known as an earpiece) that can plug into the user's ear canal. In some embodiments, primary wireless headphone 104 and secondary wireless headphone 106 may be TWS headphones, which are individual units that are not physically held by a band over the head and/or electrically connected by a cord.

In some embodiments, when primary wireless headphone 104 and secondary wireless headphone 106 are working as headphones for playing the audio information transmitted from user device 102, as shown in FIG. 1A, bidirectional communications may be established between user device 102 and primary wireless headphone 104 and between primary wireless headphone 104 and secondary wireless headphone 106 using an antenna (not shown). In some embodiments, a normal communication link may be established between user device 102 and primary wireless headphone 104 and secondary wireless headphone 106, respectively using a short-range wireless communication (e.g., the BLUETOOTH communication or WiFi communication). That is, primary wireless headphone 104 and secondary wireless headphone 106 may respectively establish a wireless communication link (e.g., a normal communication link) with user device 102 (e.g., working in normal mode). In the normal mode, primary wireless headphone 104 and secondary wireless headphone 106 may receive audio information (e.g., in data packets) to be played transmitted by a carrier wave from user device 102 via the normal communication link.

In some embodiments, audio information to be played may be a stream of audio stereo information in the form of compressed or uncompressed stereo samples for first and second audio channels, such as left-channel audio information and right-channel audio information or the like. The normal communication link may be bidirectional such that primary wireless headphone 104 and secondary wireless headphone 106 may transmit messages back to user device 102 in response to the reception of the audio information from user device 102. As described below in detail, in some embodiments, primary wireless headphone 104 and/or secondary wireless headphone 106 may transmit ACK messages to user device 102 in response to successfully receiving the audio information from user device 102 or transmit NACK messages to user device 102 in response to not successfully receiving the audio information from user device 102.

In some embodiments, audio information may be transmitted by user device 102 according to the BLUETOOTH protocol at the working radio frequency (RF) band between 2,402 MHz and 2,480 MHz or between 2,400 MHz and 2,483.5 MHz (referred to herein as "2.4 GHz"). BLUETOOTH is a wireless technology standard for exchanging data over short distances, and the BLUETOOTH protocol is one example of short-range wireless communication protocols. In one example, user device 102 may apply the advanced audio distribution profile (A2DP) of the BLUETOOTH protocol for transmitting the audio information. For example, based on the A2DP, a BLUETOOTH audio streaming of music or voice may be streamed from user device 102 to primary and secondary wireless headphones 104 and 106 over BLUETOOTH connections. In some embodiments, audio information may be transmitted by user device 102 according to the WiFi protocol at the working RF band of 2.4 GHz or 5 GHz. WiFi is a wireless technology for wireless local area networking based on the IEEE 802.11 standards, and the WiFi protocol (also known as the 802.11 protocol) is another example of short-range wireless communication protocol. It is understood that the transmission of the audio information by user device 102 may be using any other suitable short-range wireless communication besides BLUETOOTH and WiFi.

In some embodiments, when primary wireless headphone 104 and secondary wireless headphone 106 are working as a recording device for collecting/recording the audio played by audio source 101, the communication link established between user device 102, primary wireless headphone 104, and secondary wireless headphone 106 may be used for transmitting the recorded data. Specifically, in some embodiments, audio source 101 may play an audio which can be collected/recorded by primary and secondary wireless headphones 104 and 106 respectively. For example, primary and secondary wireless headphones 104 and 106 may each include a MIC (e.g., a digital MIC or an analog MIC) for collecting/recording a first and a second audio signals including the played audio and environmental noises. Because primary and secondary wireless headphones 104 and 106 are disposed on different places relative to audio source 101 (e.g., on both sides of the user's head), when combined together, a 3D representation of the played audio may be generated. This may increase the sense of orientation and sense of space of the 3D representation of the played audio comparing to existing recording schemes.

In some embodiments, before synchronizing the audio signals, primary and secondary wireless headphones 104 and 106 may synchronize a local clock (e.g., kept by a clock oscillator) of each wireless headphone. For example, primary and secondary wireless headphones 104 and 106 may transmit wireless signals indicating the local clock (e.g., the system clock) of the wireless headphone to each other for synchronizing the local clock through the communication link established between primary and secondary wireless headphones 104 and 106. For example, the wireless signal may include a synchronization code (sync code) for synchronizing the local clock of primary and secondary wireless headphones 104 and 106. In some other embodiments, primary and secondary wireless headphones 104 and 106 may respectively synchronize with user device 102 (e.g., keeping a remote clock), such that the local clocks of primary and secondary wireless headphones 104 and 106 may both be synchronized with the remote clock. For example, user device 102 may transmit to primary and secondary wireless headphones 104 and 106 a wireless signal including a sync code indicating of the remote clock (e.g., the system clock on user device 102) through the communication link established between user device 102 and primary and secondary wireless headphones 104 and 106. Upon receiving the wireless signal from user device 102 respectively by primary and secondary wireless headphones 104 and 106, primary and secondary wireless headphones 104 and 106 may synchronize with each other by respectively synchronizing with user device 102.

In some embodiments, primary wireless headphone 104 and secondary wireless headphone 106 may generate counting signals indicating a length/duration and a synchronizing signal indicating a start of the collected audio signal based on the synchronized local clocks (will be described in detail below), and may transmit the audio signals collected/recorded along with the corresponding synchronizing signals to user device 102 through the normal communication links (e.g., bidirectional) established between the user device 102 and primary wireless headphone 104 and secondary wireless headphone 106 as described above. In some embodiments, both headphones (e.g., primary wireless headphone 104 and secondary wireless headphone 106) may transmit the collected audio signals and the corresponding synchronizing signals to the user device. For example, according to the predetermined time-division arrangement, each of primary wireless headphone 104 and secondary wireless headphone 106 will alternatively take N slots (e.g., N being any suitable positive integer) at a time to transmit the collected audio signal to user device 102. In this way, when secondary wireless headphone 106 works in the snoop mode, according to the time division arrangement, user device 102 can still identify which piece/portion of audio signal comes from which headphone.

In some embodiments, the time-division arrangement may be predetermined and be transmitted from the primary wireless headphone 104 to secondary wireless headphone 106 in a time slot before the audio signal is transmitted to user device 102. Accordingly, based on the audio signals collected respectively by primary wireless headphone 104 and secondary wireless headphone 106 and the corresponding synchronizing signals, user device 102 may generate the 3D representation of the audio played by audio source 101.

Different from what is shown in FIG. 1A, in some embodiments, instead of establishing a normal communication link, a snoop communication link may be established between user device 102 and secondary wireless headphone 106 using the same short-range wireless communication between user device 102 and primary wireless headphone 104 (e.g., the BLUETOOTH or WiFi). That is, secondary wireless headphone 106 may work in the snoop mode in which the connection with secondary wireless headphone 106 may not be known by user device 102. In the snoop mode, secondary wireless headphone 106 may snoop (also known as "listen" or "eavesdrop") the communications between user device 102 and primary wireless headphone 104 on the normal communication link. By snooping the communications between user device 102 and primary wireless headphone 104, secondary wireless headphone 106 may also receive the audio information (e.g., in data packets) to be played transmitted by the carrier wave from user device 102 via the snoop communication link. The snoop communication link may be bidirectional such that secondary wireless headphone 106 may transmit messages back to user device 102 in response to the reception of the audio information from user device 102 via the snoop communication link. As described below in detail, the messages transmitted by secondary wireless headphone 106 may include, for example, ACK messages and NACK messages. In some embodiments, the ACK/NACK messages indicate whether both primary and secondary wireless headphones 104 and 106 receive the audio information successfully. For example, as described in detail below, primary and secondary wireless headphones 104 and 106 may inform each other the successful reception of the audio information through the ECC message.

In some embodiments, primary wireless headphone 104 may be configured to generate an error-correcting code (ECC) based on the audio information (e.g., by coding the payload of the BLUETOOTH audio data packet). Primary wireless headphone 104 then may transmit an error-correcting message (ECC MSG) including the ECC to secondary wireless headphone 106. The ECC may include, but not limited to, Reed-Solomon (RS) code, Bose-Chaudhuri-Hocquenghem (BCH) code, etc. In case secondary wireless headphone 106 does not successfully receive the audio information from user device 102 (e.g., error found in the payload of a BLUETOOTH audio data packet), the ECC contained in the error-correcting message from primary wireless headphone 104 may be used by secondary wireless headphone 106 to correct the audio information (e.g., the error found in the payload of the BLUETOOTH audio data packet). In some embodiments, the error-correcting message does not include an ECC, and the transmission of the error-correcting message without the ECC can only serve as an ACK message indicative of the successful reception of the audio information by primary wireless headphone 104.

Figure 1B:
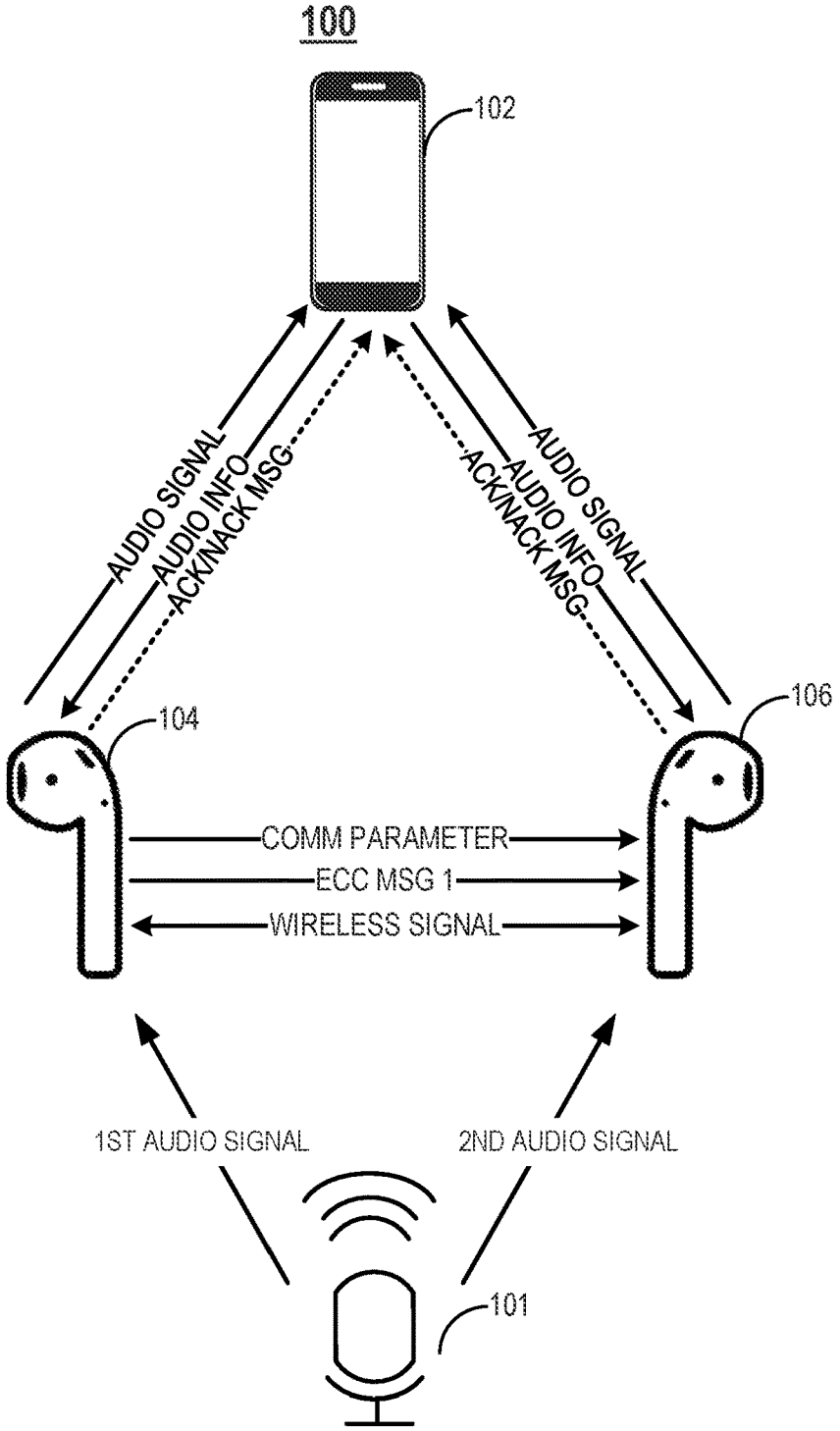

As illustrated in FIG. 1B, to enable secondary wireless headphone 106 work in the snoop mode, primary wireless headphone 104 may transmit, to secondary wireless headphone 106, communication parameters associated with the normal communication link between user device 102 and primary wireless headphone 104 using a communication link established between primary and secondary wireless headphones 104 and 106. The communication parameters may include, but are not limited to, the address of user device 102 (e.g., the IP address or media access control (MAC) address) and the encryption parameters between user device 102 and primary wireless headphone 104. The transmission of the communication parameters may be carried on by a short-range wireless communication that is the same type as that for transmitting the audio information by user device 102. For example, short-range wireless communication may also be BLUETOOTH communication or WiFi communication. In some embodiments, audio play information such as synchronizing information, frequency hopping information, volume control information, role switching information, and audio information can also be transmitted along with the communication parameters between primary wireless headphone 104 and secondary wireless headphone 106 using the communication link established between primary and secondary wireless headphones 104 and 106.

Upon receiving the communication parameters from primary wireless headphone 104, secondary wireless headphone 106 can establish the snoop communication link with user device 102 based on the communication parameters. For example, secondary wireless headphone 106 may pretend to be primary wireless headphone 104 so that user device 102 does not recognize secondary wireless headphone 106 as a newly-connected device and thus, will not disconnect and reconnect with secondary wireless headphone 106. Similar to the embodiment illustrated in FIG. 1A, when working as a recording device for collecting/recording the audio played by 101, the communication links established between user device 102, primary wireless headphone 104, and secondary wireless headphone 106 may be used. For example, primary wireless headphone 104 may transmit the collected audio signal and the corresponding synchronizing signal to user device 102 using the normal communication link, secondary wireless headphone 106 may transmit the collected audio signal to user device 102 using the snoop communication link, and primary wireless headphone 104 may transmit to/receive from secondary wireless headphone 106 the wireless signal for synchronizing the local clocks using the communication link between primary wireless headphone 104 and secondary wireless headphone 106. As secondary wireless headphone 106 pretends to be primary wireless headphone 104 when using the snoop communication link, primary wireless headphone 104 and secondary wireless headphone 106 may transmit the collected audio signals and the corresponding synchronizing signal to user device 102 according to a time-division arrangement. Accordingly, user device 102 can still distinguish which piece/portion of the audio signal came from which headphone.

In another embodiment, secondary wireless headphone 106 may transmit the collected audio signal to primary wireless headphone 104 first using the communication link between primary wireless headphone 104 and secondary wireless headphone 106, which would then transmit/redirect the audio signals collected by both primary wireless headphone 104 and secondary wireless headphone 106 to user device 102 via the normal communication link. The collected audio signals may be synchronized based on the corresponding synchronizing signals by primary wireless headphone 104 before being collectively transmitted to user device.

Figure 1C:
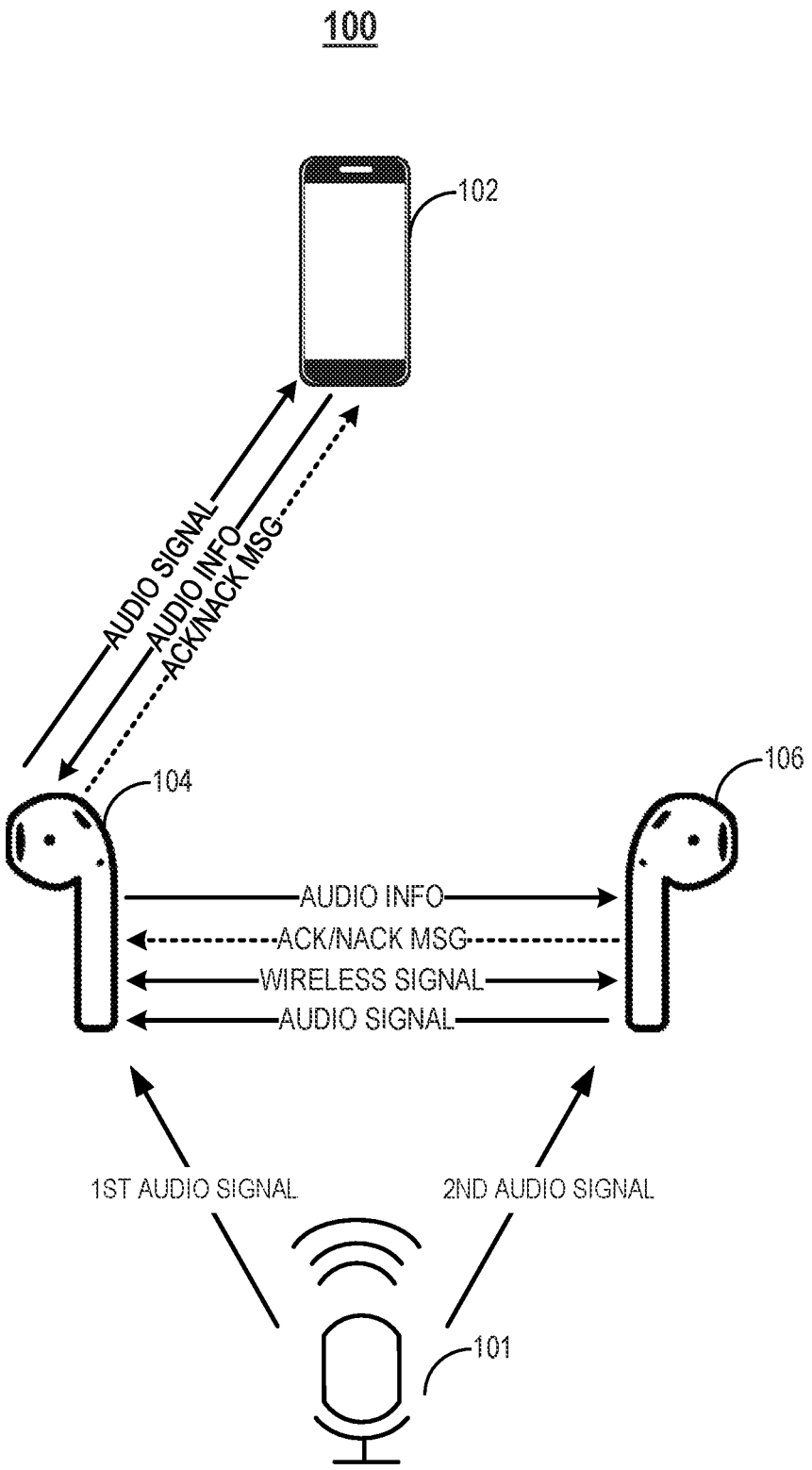

In some embodiments, as illustrated in FIG. 1C, instead of transmitting communication parameters of the normal communication link and/or the ECC MSG, primary wireless headphone 104 may redirect the audio information to secondary wireless headphone 106 using the communication link established between primary and secondary wireless headphones 104 and 106. Secondary wireless headphone 106 may also transmit the audio signal collected (e.g., the second audio signal) along with the corresponding synchronizing signal to primary wireless headphone 104, which would redirect the audio signal to user device 102 along with the audio signal collected by primary wireless headphone 104 (e.g., the first audio signal) and the corresponding synchronizing signal. In some embodiments, primary wireless headphone 104 may synchronize the first and the second audio signals based on the corresponding synchronizing signals upon receiving the second audio signal and the corresponding synchronizing signal from secondary wireless headphone 106. In other words, the first and the second audio signals are synchronized on primary wireless headphone 104 before being transmitted collectively to user device 102. Accordingly, no synchronizing signals need to be transmitted to user device 102 for synchronization.

It is understood that in implementing the wireless communication features (e.g., establishing the communication link with the user device and/or the other wireless headphone) disclosed herein, the roles of primary and secondary wireless headphones can be switched. In other words, either primary or secondary wireless headphone 104 or 106 can be the party generating and transmitting the communication parameters, the ECC, and/or the audio information (transmitting headphone), and either primary or secondary wireless headphone 104 or 106 can be the party utilizing the communication parameters, the ECC, and/or the audio information transmitted from the transmitting headphone for receiving the audio information (receiving headphone).

Figure 2:
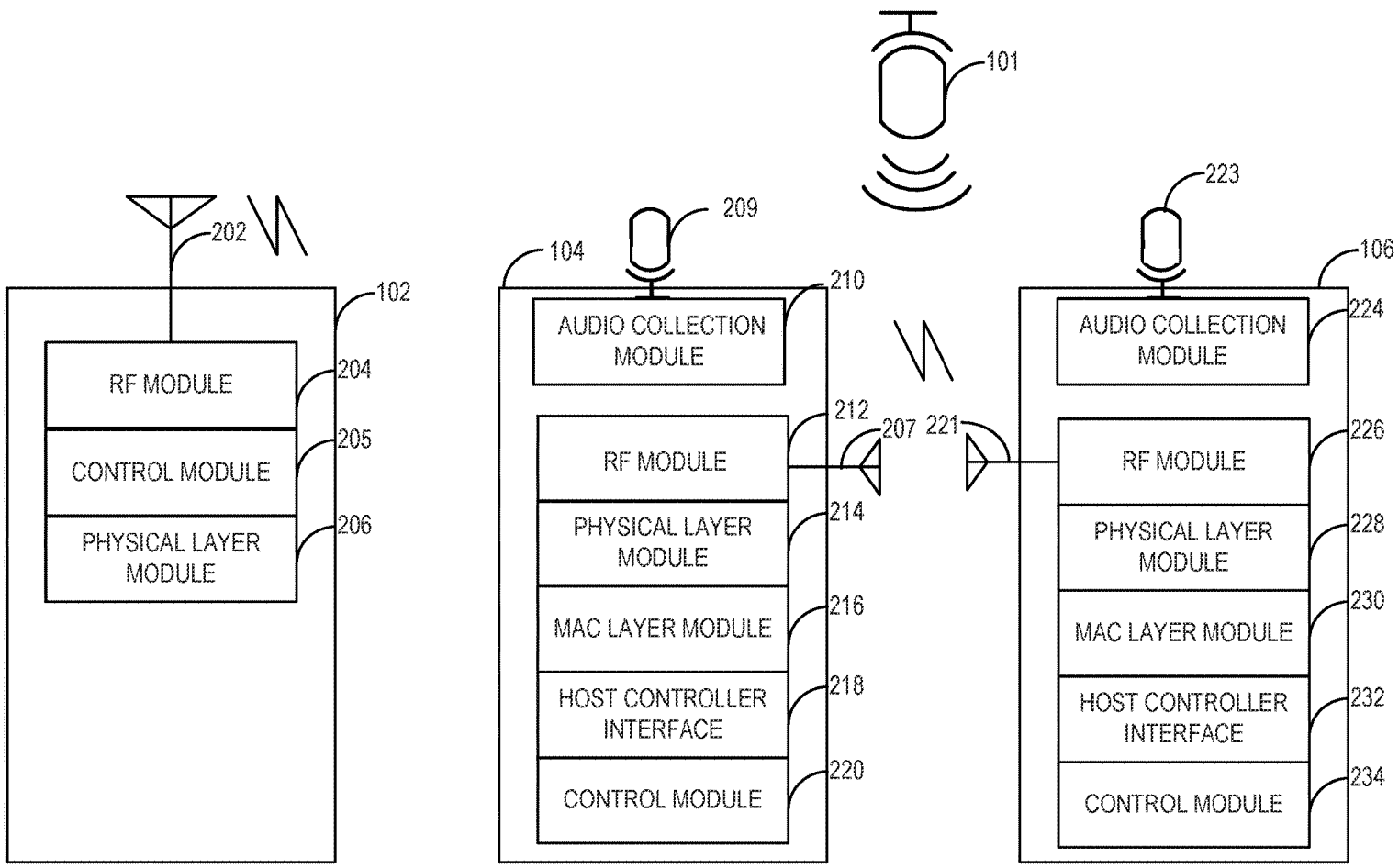
FIG. 2 is a detailed block diagram of the exemplary wireless audio system in FIGS. 1A-1C in accordance with an embodiment.

FIG. 2 is a detailed block diagram of exemplary wireless audio system 100 in FIGS. 1A-1C in accordance with an embodiment. User device 102 in this example includes an antenna 202, a radio frequency (RF) module 204, a process module 205, and a physical layer module 206. It is understood that additional module(s) may be included in user device 102, either in the same integrated circuit (IC) chip in which RF module 204, process module 205, and physical layer module 206 are formed or in a separate IC chip.

Antenna 202 may include an array of conductors for transmitting and receiving radio waves at one or more RF bands corresponding to RF module 204. For example, antenna 202 may transmit audio information to be played and receive audio signal collected by primary wireless headphone 104 and/or secondary wireless headphone 106 and the corresponding synchronizing signals modulated by a carrier wave using RF module 204. As described above, the audio information may be any music and/or voice information provided by user device 102. For example, the audio information may be a stream of audio stereo information in the form of compressed or uncompressed stereo samples for first and second audio channels, such as left-channel audio information and right-channel audio information or the like. In some embodiments, the audio information may be mono audio information in a single audio channel or audio information in more than two separate audio channels (e.g., left, central, and right channels). Antenna 202 may also receive the data modulated by a carrier wave. For example, the data may be in any format used for receiving audio signals collected by primary wireless headphone 104 and/or secondary wireless headphone 106 and the corresponding synchronizing signals. Antenna 202 may also receive messages used for receiving acknowledging the reception of the audio information by primary wireless headphone 104 or secondary wireless headphone 106, such as ACK and NACK messages.

RF module 204 and physical layer module 206 may be in the same IC chip that implements a short-range wireless communication protocol, such as the BLUETOOTH protocol or WiFi protocol. RF module 204 may be configured to modulate the audio information using the carrier wave at a frequency, for example, at 2.4 GHz for BLUETOOTH or WiFi communication, and transmit the audio information at the frequency via antenna 202. RF module 204 may be further configured to receive and demodulate the messages and/or demodulate the audio signal collected by primary wireless headphone 104 and/or secondary wireless headphone 106 from the carrier wave at the same frequency, for example, at 2.4 GHz. Physical layer module 206 may be configured to generate the physical link (baseband) between user device 102 and primary wireless headphone 104 (and secondary wireless headphone 106 even though user device 102 may not be aware of the connection with secondary wireless headphone 106) according to the short-range wireless communication protocol. For example, physical layer module 206 may generate baseband packets (e.g., BLUETOOTH packets) based on the music and/or voice data (payload) and perform error correction using any known methods, such as forward error correction (FEC) and automatic repeat request (ARQ).

Process module 205 may be configured to process the audio signals and the corresponding synchronizing signals received from primary wireless headphone 104 and/or secondary wireless headphone 106 for generating the 3D representation of the audio played by audio source 101. For example, process module 205 may include a memory configured to store the collected audio signals received and may include a processor configured to generate the 3D representation of the audio played by audio source 101. For example, process module 205 may combine/mix the audio signals received from primary wireless headphone 104 and secondary wireless headphone 106 based on the corresponding synchronizing signals to generate the 3D representation of the audio played by audio source 101. In some embodiments, the collected audio signals may already be combined/mixed by one of primary wireless headphone 104 or secondary wireless headphone 106 before being transmitted to user device 102.

In some embodiments, the transmission of the data (e.g., the audio information to be played and/or the audio signals) may occur at the audio data packet level in time slots. For example, according to the standard BLUETOOTH protocol, the physical channel of the BLUETOOTH connection is divided into time slots, each of which has the same duration (e.g., 625 μs). RF module 204 in conjunction with antenna 202 may transmit an audio data packet (N) in a time slot (N). Based on the receptions of the audio data packet (N) in the time slot (N) at primary wireless headphone 104 and secondary wireless headphone 106, in the subsequent time slot (N+1), RF module 204 in conjunction with antenna 202 may receive a message from primary wireless headphone 104 or secondary wireless headphone 106 alone, or messages from both primary wireless headphone 104 and secondary wireless headphone 106, which are generated in response to the reception status of the audio data packet (N) in the time slot (N). It is understood that additional components, although not shown in FIG. 2, may be included in user device 102.

Primary wireless headphone 104 in this example may include a wireless transceiver (primary wireless transceiver) configured to receive the audio information transmitted by user device 102 and may transmit the collected audio signal to user device 102 for generating the 3D representation of the audio played by audio source 101. The wireless transceiver may also transmit error-correcting messages (with an ECC) in response to the reception of the audio information to be played from user device 102. The wireless transceiver may be further configured to transmit the communication parameters to secondary wireless headphone 106. Primary wireless headphone 104 may include other components, such as an enclosure and speakers (not shown). Primary wireless transceiver may include an antenna 207, an audio collection module 210 including a MIC 209, an RF module 212, a physical layer module 214, a MAC layer module 216, a host controller interface (HCI) 218, and a control module 220. Some or all of the modules mentioned above may be integrated onto the same IC chip to reduce the chip size and/or power consumption. Primary wireless headphone 104 may present at least part of the audio information received from user device 102 to the user via one of the user's ear. For example, the speaker of primary wireless headphone 104 may play music and/or voice based on the entire audio information or one audio channel of the audio information. Primary wireless headphone 104 may also transmit the collected audio signal to user device 102 for generating a 3D representation of the audio played by audio source 101.

In some embodiments, audio collection module 210 may be configured to collect audio signal(s) based on the audio played by audio source 101 and may generate a synchronizing signal indicating a start and a length/duration of the collected audio signal. For example, audio source 101 may be any suitable device that can play the audio. The audio played by audio source 101 may be any audio of interest, such as music or voice. In some embodiments, control module 220 may be configured to receive the collected audio signal and the corresponding synchronizing signal from audio collection module 210 and may process the collected audio signal and the corresponding synchronizing signal accordingly.

Figure 3:
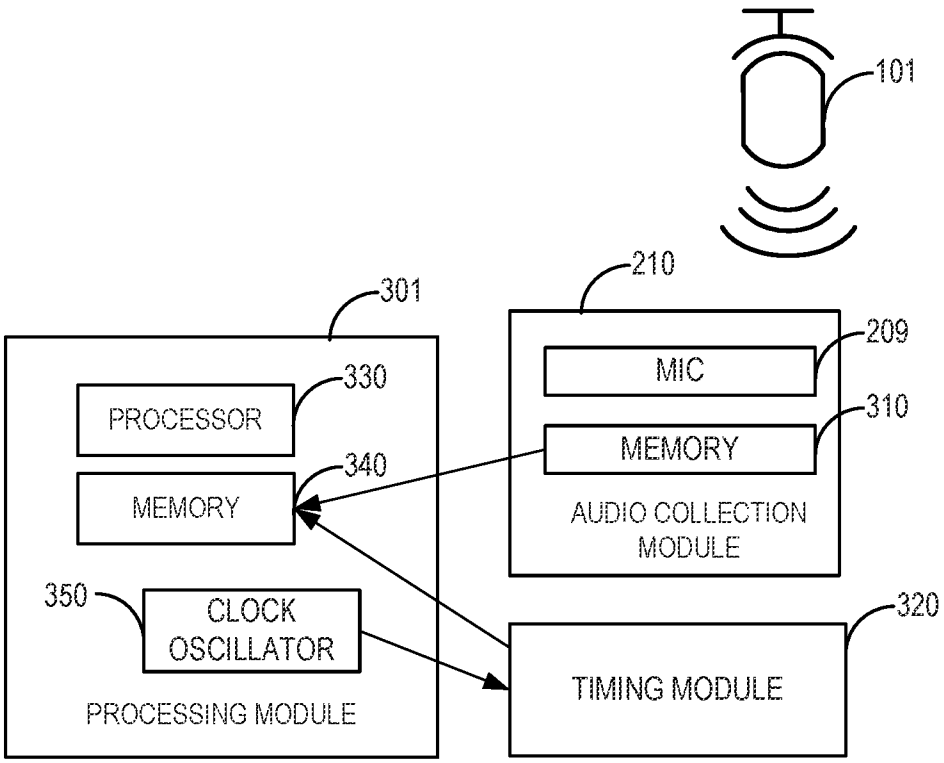
FIG. 3 is a block diagram illustrating an exemplary wireless headphone in accordance with an embodiment.

For example, as illustrated in FIG. 3, among other components, audio collection module 210 may include MIC 209, a memory 310 for temporarily store pieces of the audio signal collected by MIC 209. A timing module 320 may be configured to generate synchronizing signals accordingly. Processing module 301 may include a processor 330 for processing the collected audio signal, a memory 340 for storing the collected audio signal and record the corresponding synchronizing signal, and a clock oscillator 350 for keeping a local clock of primary wireless headphone 104.

In some embodiments, processor 330 may include microprocessors, microcontroller units (MCUs), digital signal processors (DSPs), application-specific integrated circuits (ASICs), field-programmable gate arrays (FPGAs), programmable logic devices (PLDs), state machines, gated logic, discrete hardware circuits, and other suitable hardware configured to perform the various functions described throughout the present disclosure. Processor 330 may be a hardware device having one or more processing cores. Processor 330 may execute software. Software shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise. Software can include computer instructions written in an interpreted language, a compiled language, or machine code. Other techniques for instructing hardware are also permitted under the broad category of software. Although only one processor is shown, it is understood that multiple processors can be included. In some embodiments, the antenna switching action can be implemented by setting the hardware using the software executed by Processor 330. For example, the executed software may set up a time point for the switch (e.g., when the counter/timer counts to a certain number) on the hardware. This allows the hardware to switch according to predetermined order and does not need to involve the software each time the switch happens. This would reduce the computing power used by Processor 330.

Memory 340 can broadly include both memory and storage. For example, Memory 340 may include random-access memory (RAM), read-only memory (ROM), static RAM (SRAM), dynamic RAM (DRAM), ferro-electric RAM (FRAM), electrically erasable programmable ROM (EEPROM), CD-ROM or other optical disk storage, hard disk drive (HDD), such as magnetic disk storage or other magnetic storage devices, Flash drive, solid-state drive (SSD), or any other medium that can be used to carry or store desired program code in the form of instructions that can be accessed and executed by Processor 330. Broadly, Memory 340 may be embodied by any computer-readable medium, such as a non-transitory computer- readable medium.

In some embodiments, when recording the audio played by audio source 101, the audio information collected by MIC 209 may include the audio of interest along with the environmental noises. The collected audio signal may be temporarily stored in memory 310 before being transmitted along with the corresponding synchronizing signal to processing module 301 (e.g., memory 340) for further processing. In some embodiments, when MIC 209 starts to collect the audio signal, timing module 320 may generate a counting signal indicating a length and a synchronizing signal indicating a start of the audio signal collected by MIC 209. For example, timing module 320 may generate the counting signal by counting cycles according to the local clock kept by clock oscillator 350. After MIC 209 starts to collect the audio signal, every time when a clock from audio collection module 210 counts to a predetermined number (e.g., counts to 100), a trigger may be generated (e.g., generated by audio collection module 210) such that the piece of the collected audio signal stored in memory 310 may be transmitted to memory 340. At the same time when the trigger is generated, timing module 320 may generate the synchronizing signal recording the value of the counting signal (e.g., the number of cycles counted by the counting signal). The synchronizing signal associated with the piece of the collected audio signal can also indicate the starting point of the piece of the collected audio signal similar to the way it indicates the starting point of the collected audio signal.

In some embodiments, memory 340 may access memory 310 for retrieving the data through direct memory access (DMA). For example, DMA may receive the trigger at a predetermined intermittency (e.g., each time timing module 320 counts to 100) and may access and retrieve the data (e.g., pieces of the collected audio signal with the same predetermined length) without the instruction from processor 330. In some embodiments, the predetermined length of each piece of the collected audio signal corresponds to the predetermined intermittency for receiving the trigger, which can be pre-set by an operator. As the access of memory 310 is independent from the processor 330 (e.g., processor 330 does not have to instruct to retrieve dataor), the efficiency of data access and transmission can be significantly increased. Furthermore, after initially set DMA parameters (e.g., the length of the collected audio signal accessed and retrieved by DMA), processor 330 does not have to individually set the DMA parameters each time before the DMA access and retrieve the data. So the burden of processor 330 can be further alleviated.

Referring back to FIG. 2, in some embodiments, antenna 207 may include an array of conductors for transmitting and receiving radio waves at one or more RF bands corresponding to RF module 212. In some embodiments, antenna 207 can be any of a wire antenna and/or a chip antenna. For example, the chip antenna may be thin filmed and/or laser curved on a shell of primary wireless headphone 104. The wire antenna may be winded/folded within the shell of primary wireless headphone 104.

In some embodiments, RF module 212 may be configured to receive, from user device 102, audio information to be played and transmit to user device 102, the collected audio signals, the corresponding synchronizing signals, and messages (e.g., ACK and NACK messages) via antenna 207. RF module 212 may also be configured to transmit, to secondary wireless headphone 106, the communication parameters and error-correcting messages (when primary wireless headphone 104 works as the transmitting headphone), or redirect audio information to secondary wireless headphone 106 (e.g., when the wireless audio system works in a redirect mode). In some embodiments, RF module 212 may be further configured to receive, from secondary wireless headphone 106, the communication parameters, error-correcting messages (when primary wireless headphone 104 works as the receiving headphone), or the audio information redirected from secondary wireless headphone 106. In some embodiments, RF module 212 may also be configured to receive the collected audio signal and the corresponding synchronizing signal from secondary wireless headphone 106. Control module 220 may synchronize and combine/mix the audio signals collected respectively by primary and secondary wireless headphones 104 and 106 based on the corresponding synchronizing signals before collectively transferring the combined audio signal to user device 102.

Physical layer module 214 may be configured to generate the physical links (baseband) between user device 102 and primary wireless headphone 104 according to the short-range wireless communication protocol used by RF module 212. For example, physical layer module 214 may generate baseband packets (e.g., BLUETOOTH packets) based on the music and/or voice data (payload) and perform error correction using any known methods, such as FEC and ARQ. MAC layer module 216 may be configured to generate the logical data channel links between user device 102 and primary wireless headphone 104 according to the short-range wireless communication protocol and between primary wireless headphone 104 and secondary wireless headphone 106. For example, MAC layer module 216 may generate a link control channel, link manager channel, user asynchronous channel, user isochronous channel, and user synchronous channel based on the BLUETOOTH protocol (and the amended BLUETOOTH protocol). HCI 218 may be configured to provide a common interface to physical layer module 214 and MAC layer module 216 and access to hardware status and control registers. For example, when implementing the BLUETOOTH protocol, HCI 218 may provide a uniform method of accessing the BLUETOOTH baseband capabilities. In some embodiments, the error correction messages are transmitted based on the BLUETOOTH protocol in network layers above a physical layer, for example, by MAC layer module 216 and HCI 218, and are transmitted in the physical layer, for example, by physical layer module 214.

Control module 220 may be further configured to control the generation of the ECC based on the successfully received audio information to be played when primary wireless headphone 104 is working as a transmitting headphone or control the correction of the audio information to be played based on the received ECC when primary wireless headphone 104 is working as a receiving headphone. Control module 220 may be further configured to determine whether to transmit an ACK message or a NACK message to user device 102 depending on whether the audio information is received successfully by one or both of primary and secondary wireless headphones 104 and 106. As described above, control module 220 may also be configured to retrieve the collected audio signal and record the corresponding synchronizing signal for further processing.

Secondary wireless headphone 106 in this example may include a wireless transceiver (secondary wireless transceiver) configured to receive communication parameters and/or error-correcting messages from primary wireless headphone 104 and receive/snoop the audio information transmitted by user device 102 based on the communication parameters and/or error-correcting messages. Upon establishing the snoop communication link with user device 102, secondary wireless headphone 106 may transmit the collected audio signal along with the corresponding synchronizing signals to user device 102 using the snoop communication link.

Secondary wireless headphone 106 may include other components, such as an enclosure and speakers (not shown). Secondary wireless transceiver 106 may include an antenna 221, an audio collection module 224 including a MIC 223, an RF module 226, a physical layer module 228, a MAC layer module 230, an HCI 232, and a control module 234. Some or all of the modules mentioned above may be integrated onto the same IC chip to reduce the chip size and/or power consumption. Secondary wireless headphone 106 may present at least part of the audio information to the user via one of the user's ear. For example, the speaker of secondary wireless headphone 106 may play music and/or voice based on the audio information or one audio channel of the audio information received from user device 102.

In this example, secondary wireless headphone 106 has the same hardware structures as primary wireless headphone 104. The functions of each module mentioned above in secondary wireless headphone 106 are the same as the counterparts in primary wireless headphone 104 and thus, will not be repeated. In some embodiments, secondary wireless headphone 106 may work in the same normal mode as primary wireless headphone 104. In some embodiments, different from primary wireless headphone 104, secondary wireless headphone 106 may work in the snoop mode/redirect mode. In snoop mode, user device 102 may not recognize the connection with secondary wireless headphone 106. To enable secondary wireless headphone 106 to work in the snoop mode, in some embodiments, RF module 212 of primary wireless headphone 104 may transmit, to RF module 226 of secondary wireless headphone 106, one or more communication parameters associated with the short-range wireless communication protocol used between user device 102 and primary wireless headphone 104. The communication parameters may include any parameters necessary for enabling secondary wireless headphone 106 to snoop the communications between user device 102 and primary wireless headphone 104, such as the address of user device 102 (e.g., the IP address or MAC address) and the encryption parameters used between user device 102 and primary wireless headphone 104.

Figure 4:
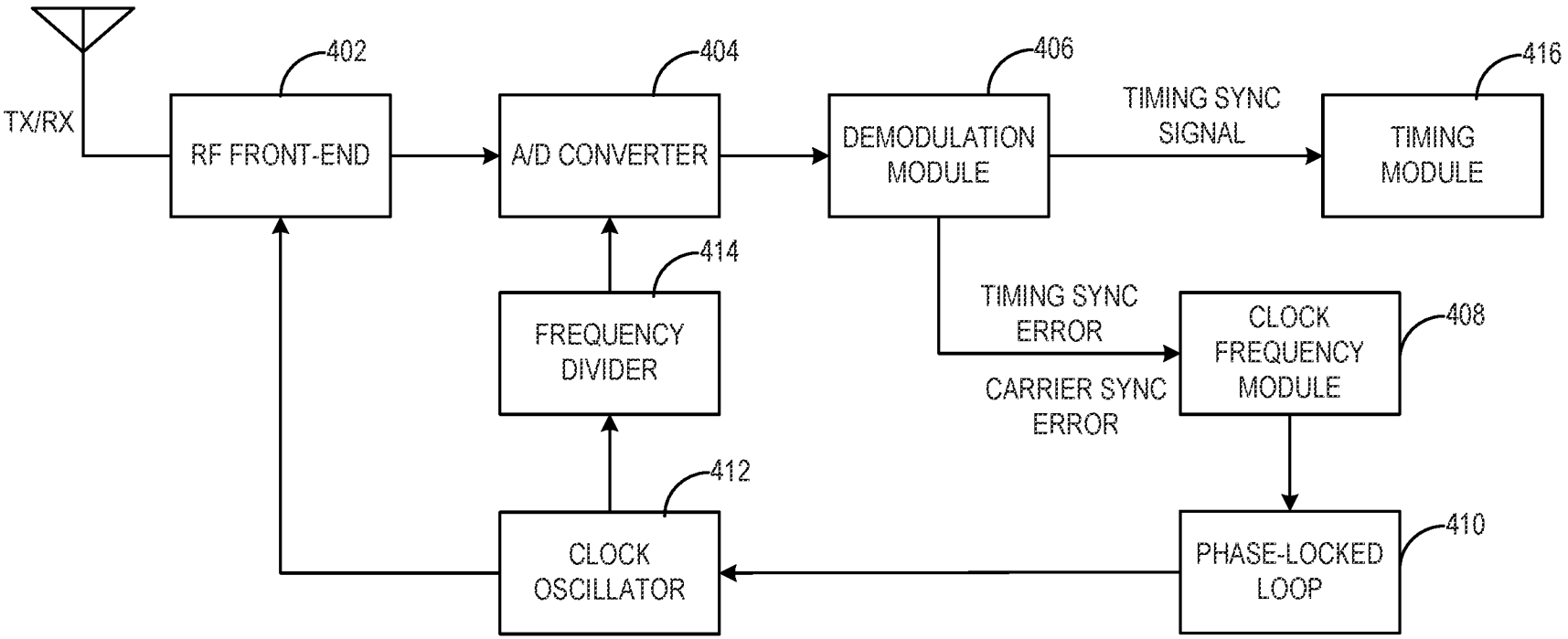
FIG. 4 is a block diagram illustrating an exemplary wireless headphone in FIG. 3 in accordance with an embodiment.

FIG. 4 is a block diagram illustrating an exemplary wireless headphone 104 or 106 in accordance with an embodiment. In this example, each of primary wireless headphone 104 and secondary wireless headphone 106 includes an RF front-end 402, an analog-to-digital (A/D) converter 404, a demodulation module 406, a clock frequency module 408, a phase-locked loop (PLL) 410, a clock oscillator 412, a frequency divider 414, and a timing module 416. RF front-end 402 may be operatively coupled to the antenna (e.g., antenna 207) and configured to receive/transmit the RF signals, such as audio signals representing the audio information described above in detail. RF front-end 402 may include low-noise amplifier (LNA), power amplifier (PA), filter, etc. A/D converter 404 may be operatively coupled to RF front-end 402 and configured to convert an audio signal from an analog signal to a digital signal and provide the digital audio signal to demodulation module 406 that is operatively coupled to A/D converter 404. The A/D conversion may be performed by A/D converter 404 based on an A/D sampling rate determined by frequency divider 414.

In some embodiments, primary wireless headphone 104 and secondary wireless headphone 106 may not communicate directly except for transmitting the communication parameters, error correction messages, the audio information, and/or collected audio signals as described above. Primary wireless headphone 104 and secondary wireless headphone 106 may be synchronized via their communications with user device 102. The local clocks of each of primary wireless headphone 104 and secondary wireless headphone 106 may be synchronized with the remote clock of user device 102 and thus, are synchronized with one another. In some other embodiments, primary wireless headphone 104 and secondary wireless headphone 106 may be synchronized directly by transmitting a wireless signal. For example, the wireless signal may include a synchronization code indicating the local clock of the transmitting wireless headphone. The receiving headphone can receive the wireless signal and synchronize the local clock with the local clock of the transmitting headphone. By synchronizing primary wireless headphone 104 and secondary wireless headphone 106 directly (e.g., by transmitting wireless signals) or indirectly (e.g., via user device 102), the synchronizing signals indicating the start of the collected audio signal can be of the same local clock. Accordingly, the audio signals collected respectively by primary wireless headphone 104, and secondary wireless headphone 106 can be synchronized for generating the 3D representation of the audio played by audio source 101 based on the corresponding synchronizing signals.

Figure 5A:
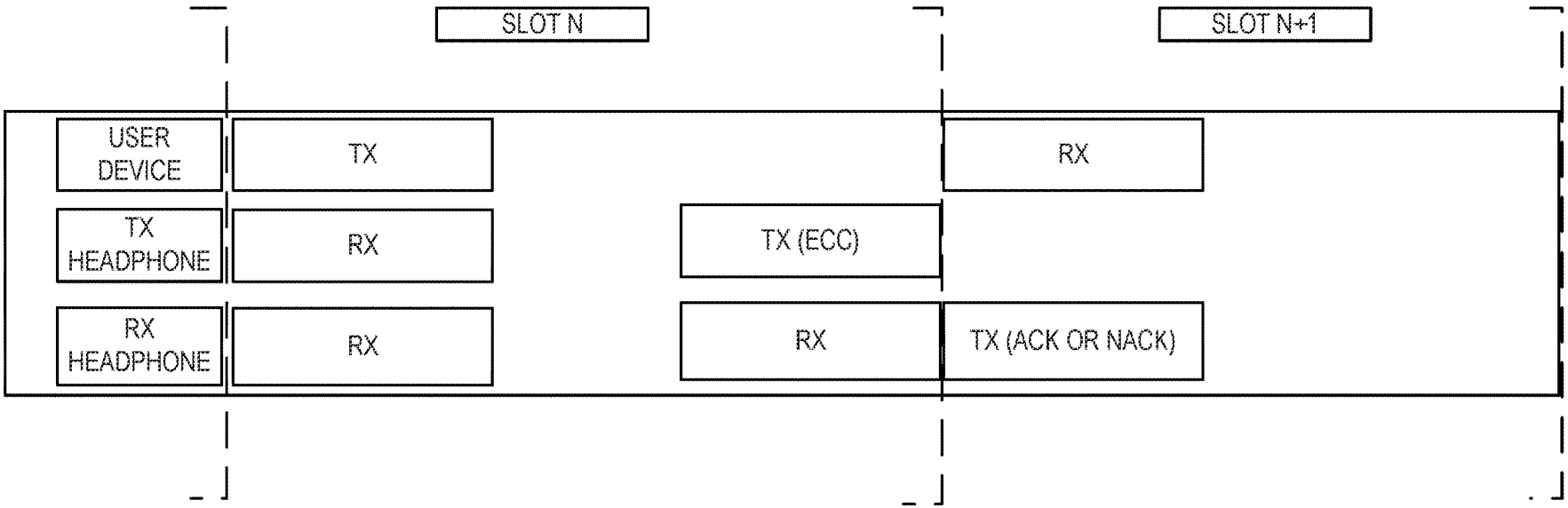
FIGS. 5A and 5B are timing diagrams of exemplary wireless audio systems for transmitting audio information in accordance with various embodiments.
Figure 5B:
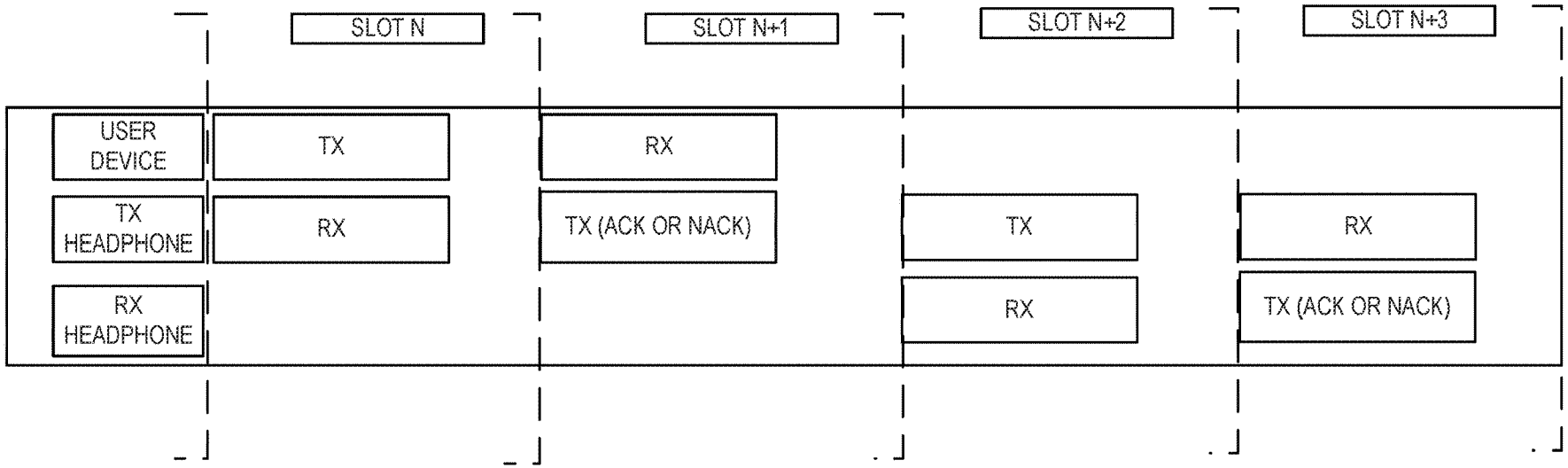

FIGS. 5A-5B are timing diagrams of exemplary wireless audio systems for transmitting audio information in accordance with various embodiments. As described above, error-correcting messages may be transmitted from a transmitting headphone to a receiving headphone. As described above, in some embodiments, each of the time slots (e.g., N and N+1) has the same duration, for example, 625 μs for BLUETOOTH communication. As shown in FIG. 5A, in a first time slot (N), the user device transmits an audio data packet (e.g., a BLUETOOTH audio data packet), and each of the transmitting headphone (e.g., through normal communication link in FIG. 2) and receiving headphones (e.g., through snoop link) receives the audio data packet. In the same time slot (N), the transmitting headphone transmits an error-correcting message including an ECC and/or an ACK/NACK message indicating whether the transmitting headphone successfully receives the audio data packet in time slot (N). In the same time slot (N), the receiving headphone receives the error-correcting message or ACK/NACK message from the transmitting headphone.

In a second time slot (N+1) immediately subsequent to the first time slot (N), the receiving headphone may transmit an ACK message or a NACK message to the user device indicating whether it successfully receives the audio data packet based on the error-correcting message in the first time slot (N).

It is understood that in FIG. 5A, each audio data packet is transmitted within a single time slot, e.g., the first time slot (N), for example, according to BLUETOOTH Hands Free Profile (HFP). In the time slot in which the audio data packet is transmitted by the user device, the audio data packet and the error-correcting message can share the same time slot. For example, the audio data packet may be transmitted prior to the error-correcting message in the same time slot. In some embodiments, each audio data packet can be transmitted within multiple time slots, for example, according to BLUETOOTH A2DP.

As shown in FIG. 5B, the audio data packet is transmitted from the user device to the transmitting headphone in N slots, and in a time slot immediately subsequent to the last one of N slots, e.g., (N+1)th slot, an ACK/NACK message indicating whether it successfully receives the audio data packet is transmitted from the transmitting headphone to the audio source. In the next slot, e.g., (N+2)th slot, the transmitting headphone transmits the audio information (e.g., redirect) to the receiving headphone. In the next slot, e.g., (N+2)th slot, the receiving headphone transmits an ACK/NACK message indicating whether it successfully receives the audio data packet to the transmitting headphone as described above in detail.

It is further understood that in some embodiments, the error-correcting message may be transmitted in more than one time slot. In the case in which the audio data packet and the error-correcting message are transmitted in N time slots (e.g., 3 or 5 time slots), the specific numbers of time slots within the N time slots used for transmitting the respective audio data packet and the error-correcting message are not limited as long as the audio data packet is transmitted prior to the error-correcting message in the N time slots. Thus, the error-correcting message may be transmitted in the last one or more time slots of the N time slots.

In addition to transmitting the audio information related data, both headphones (e.g., the transmitting headphone and the receiving headphone) may also transmit the collected audio signals and the corresponding synchronizing signals to the user device according to a predetermined time-division arrangement. For example, according to the predetermined time-division arrangement, each of the transmitting headphone and the receiving headphone will alternatively take one or more slots at a time to transmit the audio signal to the user device. In this way, when working in the snoop mode, e.g., where the receiving headphone pretends to be the transmitting headphone when communicating with the user device using the communication parameters of the normal wireless communication link between the user device and the transmitting headphone, according to the time division arrangement, the user device can still identify which piece/portion of audio signal comes from which headphone.

Figure 6:
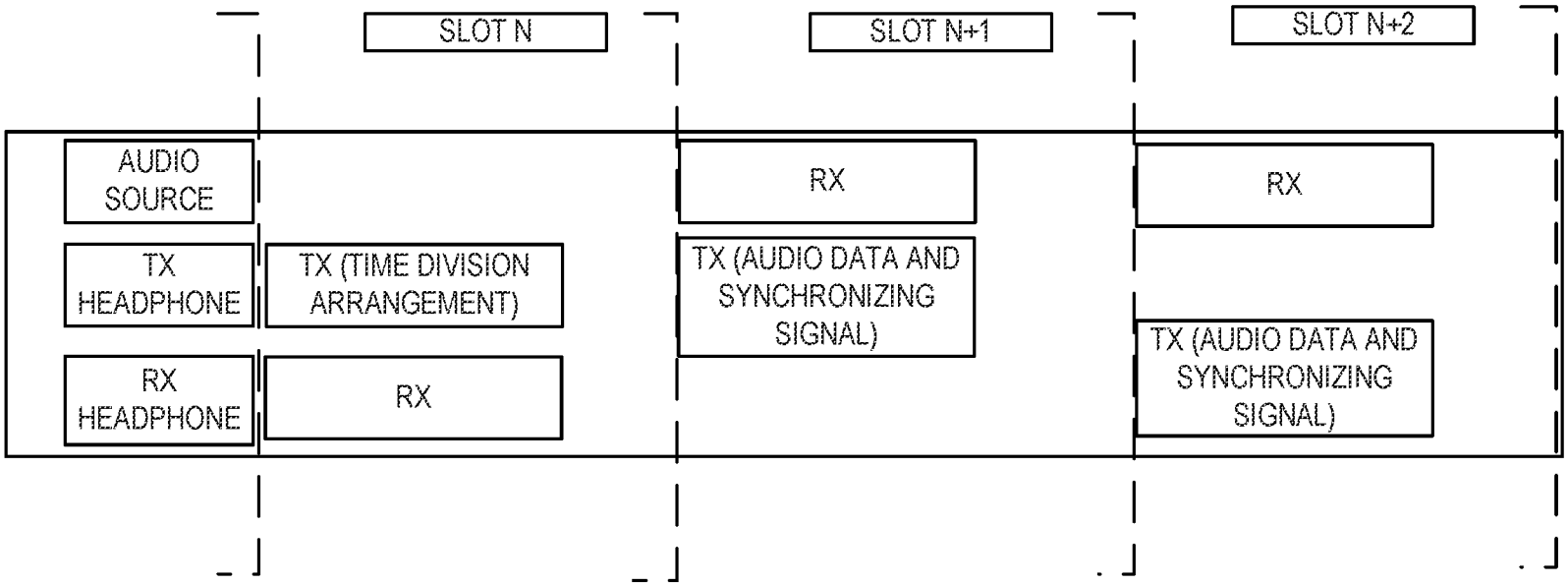
FIG. 6 is a timing diagram of exemplary wireless audio systems for transmitting audio signals in accordance with various embodiments.

In some embodiments, the time-division arrangement may be predetermined and be transmitted from the transmitting headphone to the receiving headphone in a time slot before the audio signal is transmitted to the user device. For example, as illustrated in FIG. 6, in Nth time slot, the time division arrangement may be transmitted from transmitting headphone to the receiving headphone. In the next time slot, e.g., N+1th time slot, both the transmitting and receiving headphone may start to transmit the collected audio signals and the corresponding synchronizing signals to the user device according to the time division arrangement. For example, as illustrated in FIG. 6, starting from N+1th time slot, the transmitting headphone and the receiving headphone may alternatively transmit the collected audio signal and the corresponding synchronizing signals to the user device according to the time division arrangement.

Figure 7A:
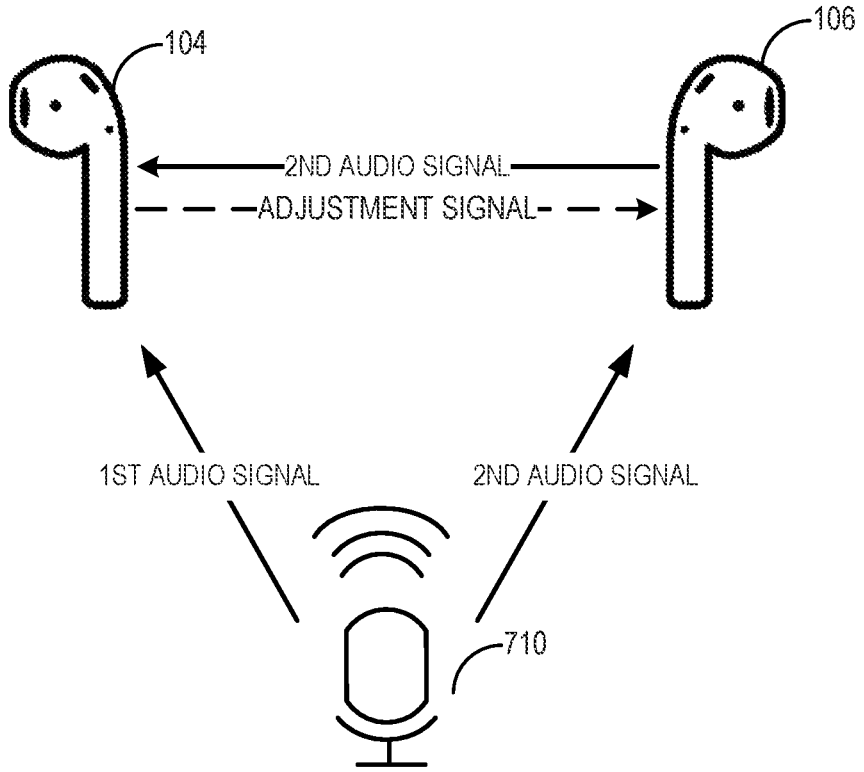
FIGS. 7A and 7B are block diagrams illustrating an exemplary testing system in accordance with various embodiments.
Figure 7B:
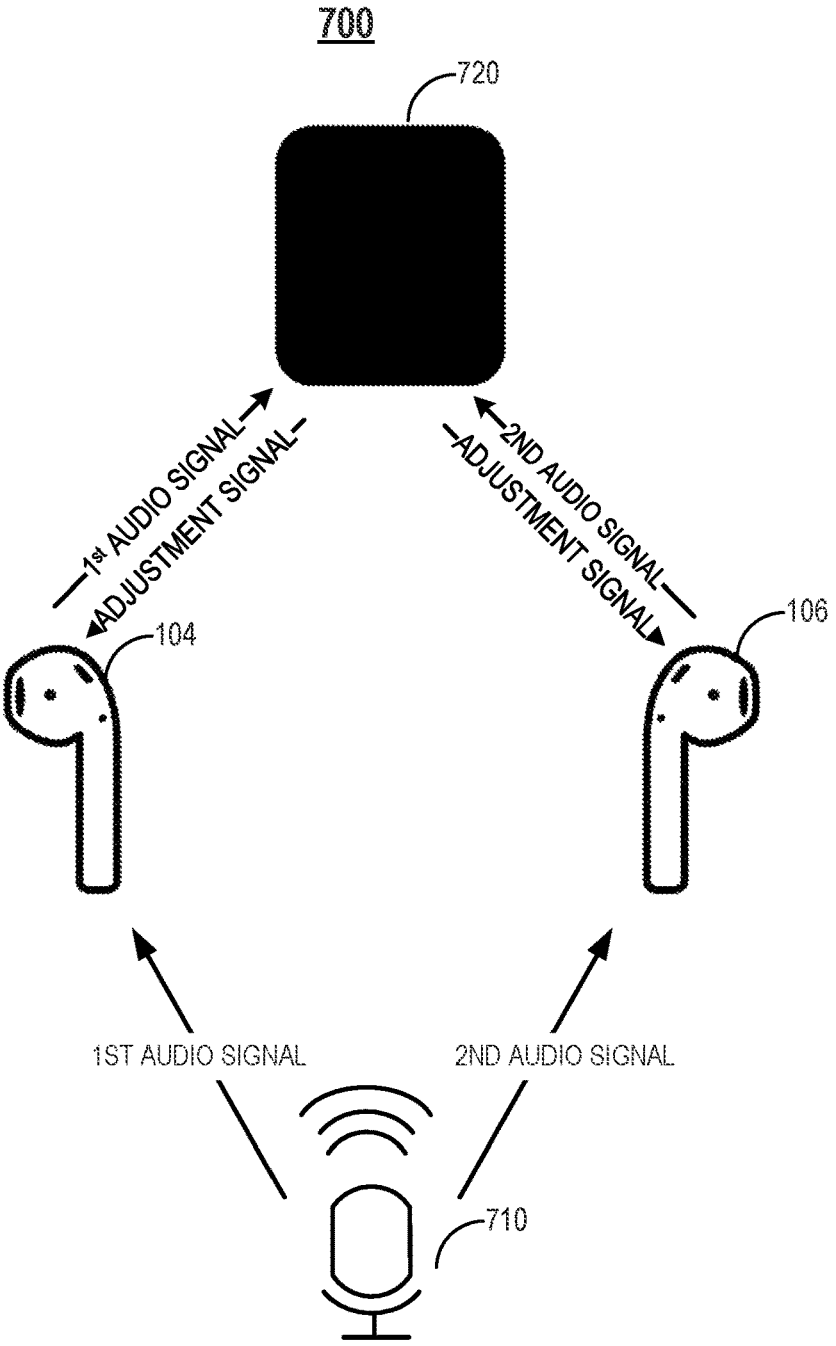

In some embodiments, before being used, primary wireless headphone 104 and secondary wireless headphone 106 may be calibrated such that when collecting/recording the same audio, the audio signals respectively collected by primary wireless headphone 104 and secondary wireless headphone 106 may have substantially the same gain and the same phase. FIGS. 7A and 7B are block diagrams illustrating an exemplary testing system 700 in accordance with various embodiments. As illustrated in FIG. 7A, in some embodiments, testing system 700 may include primary wireless headphone 104, secondary wireless headphone 106, and a test device 710 configured to play the audio (e.g., a test audio). Primary wireless headphone 104 and secondary wireless headphone 106 may respectively collect a $1^{st}$ audio signal and a $2^{nd}$ audio signal. Besides the wireless signals for synchronizing the local clock and the synchronizing signals for synchronizing the collected audio signals, secondary wireless headphone 106 may also transmit the $2^{nd}$ audio signal (i.e., the audio signal collected by secondary wireless headphone 106) to primary wireless headphone 104 for calibration using the wireless communication link established in between. In some embodiments, when adjusting the gain of the collected audio signal, secondary wireless headphone 106 may instead transmit the energy of the $2^{nd}$ audio signal to primary wireless headphone 104.

Upon receiving the $2^{nd}$ audio signal from secondary wireless headphone 106, primary wireless headphone 104 may generate adjustment signal(s) (e.g., by control module 220 in FIG. 2) based on comparing the $1^{st}$ audio signal and the $2^{nd}$ audio signal with the test audio or based on comparing the $1^{st}$ audio signal and the $2^{nd}$ audio signal. In some embodiments, when adjusting the gain, only the energy of the $1^{st}$ audio signal, the $2^{nd}$ audio signal, and the test audio are compared. In some embodiments, the adjustment signals are configured to adjust least one of a gain and/or a phase of the $1^{st}$ audio signal and/or the $2^{nd}$ audio signal. In some embodiments, primary wireless headphone 104 may adjust itself (e.g., adjusting audio collection module 210 and/or control module 220 in FIG. 2) so that the gain and/or the phase of the $1^{st}$ audio signal may be substantially the same as the gain and/or the phase of $2^{nd}$ audio signal. The gain of the $1^{st}$ audio signal and the $2^{nd}$ audio signal may be adjusted according to the test audio. For example, if the average amplitude of the test audio is low, the gain of the $1^{st}$ audio signal and the $2^{nd}$ audio signal may be set at relatively large.

In some embodiments, if the gain and/or phase adjustment for secondary wireless headphone 106 indicated by the adjustment signal is larger than a predetermined threshold, primary wireless headphone 104 may transmit the adjustment signal to secondary wireless headphone 106 for adjusting secondary wireless headphone 106 (e.g., adjusting audio collection module 224 and/or control module 234 in FIG. 2) so that the gain and/or the phase of the $2^{nd}$ audio signal may be substantially the same as the gain and/or the phase of the $1^{st}$ audio signal. In other words, if the phase and/or the gain difference of the $1^{st}$ audio signal and the $2^{nd}$ audio signal is small enough (e.g., smaller than the predetermined threshold), the adjustment signal may be refrained from being transmitted to secondary wireless headphone 106.

In some embodiments, because the phase and/or the gain difference of the $1^{st}$ and the $2^{nd}$ audio signals may sometimes vary among the frequency spectrum (e.g., the $1^{st}$ and the $2^{nd}$ audio signals may have different phase and/or gain difference at different frequency bands), to have the best sound effect for the generated 3D representation of the audio, primary wireless headphone 104 may focus the calibration on certain frequency band(s) when calibrating the phase and/or the gain of the $1^{st}$ and the $2^{nd}$ audio signals. In some embodiments, primary wireless headphone 104 may filter the $1^{st}$ and the $2^{nd}$ audio signals when generating the adjustment signals for better calibration.

For example, as human ears are more sensitive to the phase difference at a lower frequency band (e.g., lower than 3 k HZ), when generating adjustment signals for adjusting the phase difference, primary wireless headphone 104 may apply a low-pass filter (e.g., lower than 3 k HZ) to filter the $1^{st}$ and the $2^{nd}$ audio signals to pass signals with a frequency lower than a predetermined frequency, and calibrate primary wireless headphone 104 and/or secondary wireless headphone 106 based on the phase difference of the lower frequency band. In some embodiments, a band-pass filter (e.g., 2.5 k-3.5 k HZ) may also be used for calibrating primary wireless headphone 104 and/or secondary wireless headphone 106, similar to the use of the low-pass filter.

For another example, as human ears are more sensitive to the gain difference at a higher frequency band (e.g., higher than 3 k HZ), when generating adjustment signals for adjusting the phase difference, primary wireless headphone 104 may apply a high pass filter to filter the $1^{st}$ and the $2^{nd}$ audio signals to pass signals with a frequency higher than a predetermined frequency, and calibrate primary wireless headphone 104 and/or secondary wireless headphone 106 based on the gain difference of the higher frequency band. In some embodiments, a band-pass filter (e.g., 2.5 k-3.5 k HZ) may also be used for calibrating primary wireless headphone 104 and/or secondary wireless headphone 106, similar to the use of the high-pass filter.

In some embodiments, instead of communicating wirelessly (e.g., for transmitting the $1^{st}$ audio signal and the $2^{nd}$ audio signal, and the adjustment signals), primary wireless headphone 104 and secondary wireless headphone 106 may communicate through a charging case while sitting in the charging case. For example, as illustrated in FIG. 7B, testing system 700 may further include a charging case 720 where both primary wireless headphone 104 and secondary wireless headphone 106 may transmit the recorded audio signal (e.g., the $1^{st}$ audio signal and the $2^{nd}$ audio signals respectively) to charging case 720 through contact points. Charging case 720 may play the role of primary wireless headphone 104 for generating the adjustment signals based on the $1^{st}$ audio signal, the $2^{nd}$ audio signal, and the test audio as shown in FIG. 7A.

Figure 8:
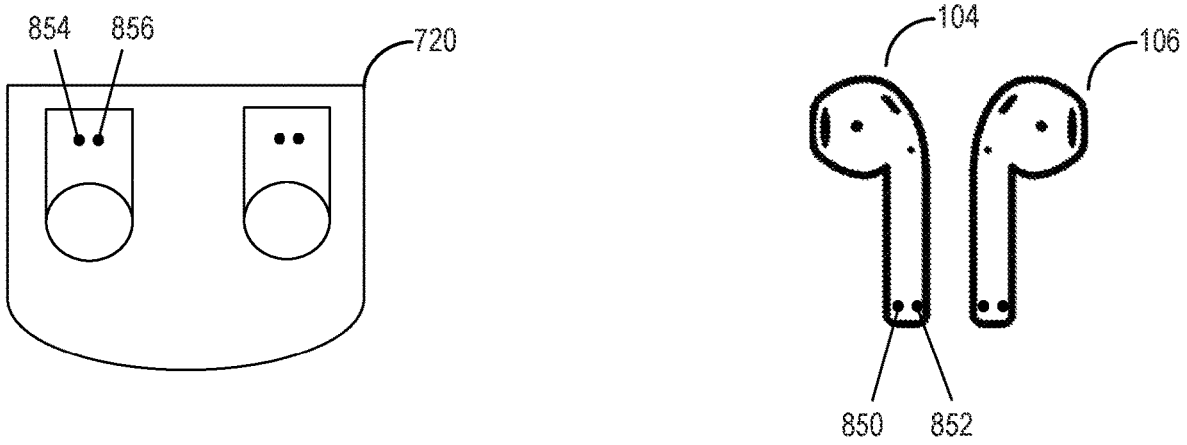
FIG. 8 is a block diagram illustrating an exemplary charging case and wireless headphones in accordance with various embodiments.

FIG. 8 is a block diagram illustrating an exemplary charging case and wireless headphones in accordance with various embodiments. For example, charging case 720 may include a contact interface (e.g., contact points 854 and 856) configured to transmit the data (e.g., (e.g., the $1^{st}$ audio signal, the $2^{nd}$ audio signal, and the adjustment signals). Charging case 720 may additionally include other components, such as an integrated circuit (e.g., a micro controller) configured to convert the received data into corresponding electrical signals (e.g., a voltage or a current) for transmission. For example, contact point 854 may be connected to the charge of the integrated circuit and contact point 856 may be connected to Ground. In some embodiments, the change of the voltage difference of contact points 854 and 856 may be used as the corresponding electrical signal for transmitting the data.

In some embodiments, the contact interface of primary wireless headphone 104 (e.g., contact points 850 and 852) and the contact interface of charging case 720 (e.g., contact points 854 and 856) may be connected to each other. Along with the integrated circuits in primary wireless headphone 104 and charging case 720, data can be communicated between primary wireless headphone 104 and charging case 720. For example, the integrated circuit in charging case 720 along with the integrated circuit in primary wireless headphone 104 may constitute a bidirectional half-duplex communication system when the interface of primary wireless headphone 104 and charging case 720 are connected, where primary wireless headphone 104 can communicate with charging case 720 in both directions, one at a time. The same mechanism works for the communication between secondary wireless headphone 106 and charging case 720.

It is contemplated that the contact interface of primary wireless headphone 104 and charging case 720 are not limited to the way as illustrated in FIG. 8. For example, the contact interface of primary wireless headphone 104 and charging case 720 may each include more than 2 contact points (e.g., 3, 4, 5 or more contact points) and may be in a bar shape or a donut shape that can match each other, or may be in any suitable format of contact interfaces that can transmit current when contacting each other.

By using charging case 720 for calibrating primary wireless headphone 104 and secondary wireless headphone 106, the computing power on primary wireless headphone 104 can be saved. Also, this can also free up the memory space in primary wireless headphone 104 such that primary wireless headphone 104 does not need to store the $1^{st}$ audio signal, the $2^{nd}$ audio signal, and the test audio simultaneously. Moreover, transmitting data, such as the $1^{st}$ audio signal, the $2^{nd}$ audio signal, and the adjustment signals through a wire (e.g., via the contact points) can make the data transmission more efficient and more robust.

Figure 9:
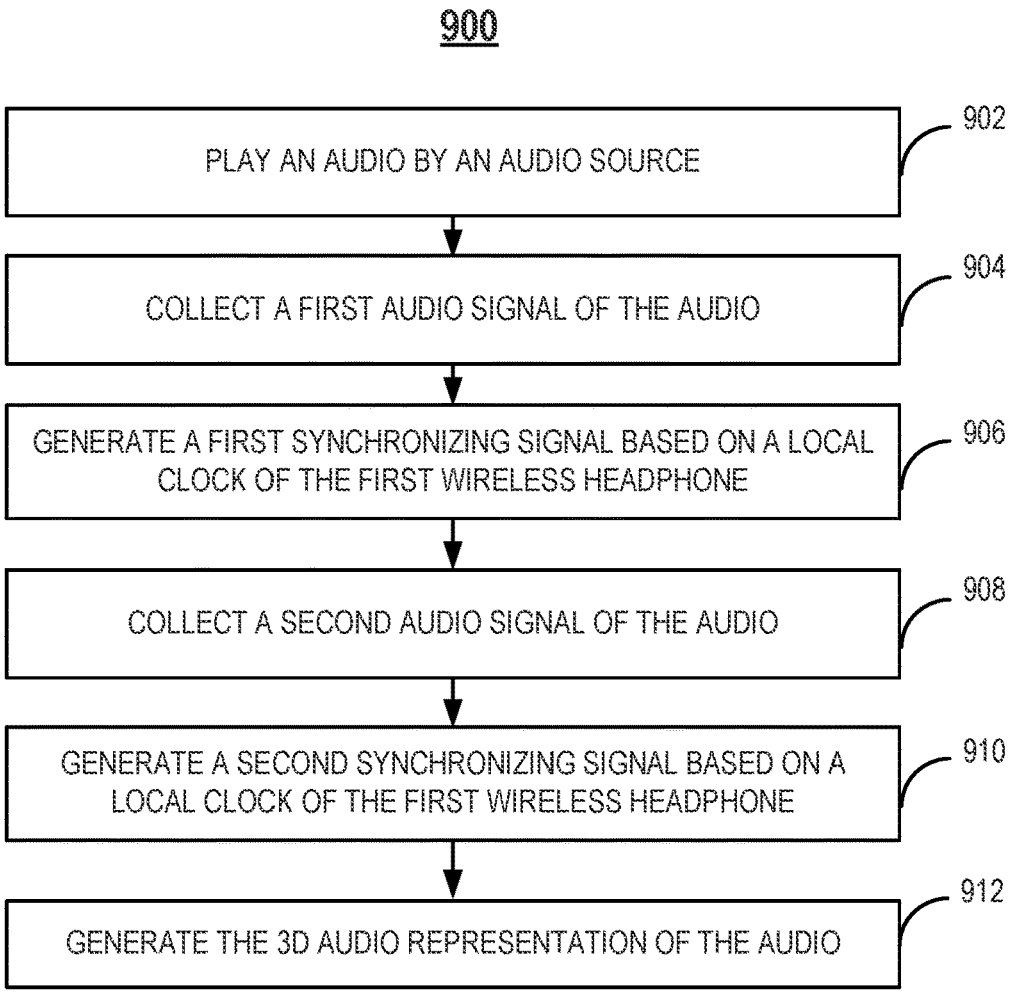
FIG. 9 is a flow chart illustrating an exemplary method for generating a 3D audio representation of an audio in accordance with an embodiment.

FIG. 9 is a flow chart illustrating an exemplary method 900 for generating a 3D audio representation of an audio in accordance with an embodiment. Method 900 can be performed by processing logic that can comprise hardware (e.g., circuitry, dedicated logic, programmable logic, microcode, etc.), software (e.g., instructions executing on a processing device), or a combination thereof. It is to be appreciated that not all operations may be needed to perform the disclosure provided herein. Further, some of the operations may be performed simultaneously, or in a different order than shown in FIG. 9, as will be understood by a person of ordinary skill in the art.

Method 900 shall be described with reference to FIGS. 1A-1C and 2-6. However, method 900 is not limited to that exemplary embodiment. Starting at 902, an audio is generated by an audio source (e.g., audio source 101). The audio can be any audio of interest, such as music or voice. At 904, a first audio signal is collected by a first wireless headphone (e.g., primary wireless headphone 104). As described above, the first wireless headphone may include an audio collection module (e.g., audio collection module 210) including a MIC configured to collect the first audio signal. In some embodiments, the first audio signal may include the audio of interest and environmental noise. At 906, a first synchronizing signal is generated based on a local clock of the first wireless headphone. For example, the first wireless headphone may include a processing unit (e.g., processing module 301) for keeping the local clock and for recording the synchronizing signal indicating the start and the length/duration of the first audio signal based on the local clock. For example, as described above, the processing unit may record the synchronizing signal and retrieve a piece/portion of the first audio signal using DMA based on receiving a trigger from the audio collection module. The synchronizing signal may be associated with the first audio signal in the processing unit.

At 908 and 910, a second audio signal and the corresponding synchronizing signal are collected and generated by a second wireless headphone (e.g., secondary wireless headphone 106) in a similar manner as at 904 and 906, simultaneously to the generation of the first audio signal and the corresponding synchronizing signal. At 912, a 3D representation of the audio may be generated by a user device (e.g., user device 102) based on the first and the second audio signals and the corresponding synchronizing signals. For example, the first and the second audio signals and the corresponding synchronizing signals may be transmitted to the user device using the communication links established in between (e.g., the normal communication link and/or the snoop communication link). The user device may synchronize the first and the second audio signals based on the corresponding synchronizing signals (e.g., by aligning the start of the first and the second audio signals). The user device may then generate the 3D representation of the audio based on the synchronized the first and the second audio signals.

It is to be appreciated that the Detailed Description section, and not the Summary and Abstract sections, is intended to be used to interpret the claims. The Summary and Abstract sections may set forth one or more but not all exemplary embodiments of the present disclosure as contemplated by the inventor(s), and thus, are not intended to limit the present disclosure or the appended claims in any way.

While the present disclosure has been described herein with reference to exemplary embodiments for exemplary fields and applications, it should be understood that the present disclosure is not limited thereto. Other embodiments and modifications thereto are possible, and are within the scope and spirit of the present disclosure. For example, and without limiting the generality of this paragraph, embodiments are not limited to the software, hardware, firmware, and/or entities illustrated in the figures and/or described herein. Further, embodiments (whether or not explicitly described herein) have significant utility to fields and applications beyond the examples described herein.

Embodiments have been described herein with the aid of functional building blocks illustrating the implementation of specified functions and relationships thereof. The boundaries of these functional building blocks have been arbitrarily defined herein for the convenience of the description. Alternate boundaries can be defined as long as the specified functions and relationships (or equivalents thereof) are appropriately performed. Also, alternative embodiments may perform functional blocks, steps, operations, methods, etc. using orderings different than those described herein.

The breadth and scope of the present disclosure should not be limited by any of the above-described exemplary embodiments, but should be defined only in accordance with the following claims and their equivalents.

What is claimed is:

1. A wireless audio system for recording, comprising a first wireless headphone and a second wireless headphone, wherein the first wireless headphone is configured to collect a first audio signal of a test audio;

the second wireless headphone is configured to collect a second audio signal of the testing audio; and the first wireless headphone is further configured to:

generate a first adjustment signal and a second adjustment signal based on the test audio, the first audio signal, and the second audio signal, wherein the first and the second adjustment signals are configured to adjust least one of a gain or a phase of the first and the second audio signal respectively; and adjust the first audio signal based on the first adjustment signal.

2. The wireless audio system of claim 1, wherein, in response to the second adjustment signal indicating an adjustment of at least one of the gain or the phase of the second audio signal, the second wireless headphone is further configured to:

receive the second adjustment signal; and adjust the second audio signal based on the second adjustment signal.

3. The wireless audio system of claim 1, wherein the second wireless headphone is further configured to transmit at least one of the second audio signal or energy of the second audio signal to the first wireless headphone.

4. The wireless audio system of claim 3, wherein the first and the second adjustment signals are generated based on comparing energy of the test audio with the energy of the first audio signal and the energy of the second audio signal, respectively.

5. The wireless audio system of claim 1, wherein the first and the second adjustment signals are configured to adjust the first and the second audio signals respectively to have substantially a same gain.

6. The wireless audio system of claim 5, wherein the first wireless headphone is further configured to filter the first audio signal, to pass signals with a frequency higher than a predetermined frequency.

7. The wireless audio system of claim 1, wherein the first and the second adjustment signals are configured to adjust the first and the second audio signals respectively to have substantially a same phase.

8. The wireless audio system of claim 7, wherein the first wireless headphone is further configured to filter the first audio signal, to pass signals with a frequency lower than a predetermined frequency.

9. The wireless audio system of claim 1, wherein the first wireless headphone is further configured to:

generate a synchronizing signal based on a local clock of the first wireless headphone; and transmit the synchronizing signal to the second wireless headphone; and the second wireless headphone is further configured to synchronize the second audio signal with the first audio signal based on the synchronizing signal.

10. A method for generating a three-dimensional (3D) audio representation of an audio, comprising:

collecting, by a first wireless headphone, a first audio signal of a test audio;

collecting, by a second wireless headphone, a second audio signal of the testing audio;

generating, by the first wireless headphone, a first adjustment signal and a second adjustment signal based on the test audio, the first audio signal, and the second audio signal, wherein the first and the second adjustment signals are configured to adjust least one of a gain or a phase of the first and the second audio signal respectively; and adjusting, by the first wireless headphone, the first audio signal based on the first adjustment signal.

11. The method of claim 10, wherein, in response to the second adjustment signal indicating an adjustment of at least one of the gain or the phase of the second audio signal, the method further comprising:

receiving, by a second wireless headphone, the second adjustment signal; and adjusting, by a second wireless headphone, the second audio signal based on the second adjustment signal.

12. The method of claim 10, further comprising:

transmitting, by the second wireless headphone, at least one of the second audio signal or energy of the second audio signal to the first wireless headphone.

13. The method of claim 12, wherein the first and the second adjustment signals are generated based on comparing energy of the test audio with the energy of the first audio signal and the energy of the second audio signal, respectively.

14. The method of claim 13, wherein the first and the second adjustment signals are configured to adjust the first and the second audio signals respectively to have substantially a same gain.

15. The method of claim 10, further comprising:

filtering, by the first wireless headphone, the first audio signal, to pass signals with a frequency higher than a predetermined frequency.

16. The method of claim 10, wherein the first and the second adjustment signals are configured to adjust the first and the second audio signals respectively to have substantially a same phase.

17. The method of claim 16, further comprising:

filtering, by the first wireless headphone, the first audio signal, to pass signals with a frequency lower than a predetermined frequency.

* * * * *